US009615652B2

(12) United States Patent
Weis et al.

(10) Patent No.: US 9,615,652 B2
(45) Date of Patent: Apr. 11, 2017

(54) BROOM HEAD WITH BRISTLE STRUCTURE

(75) Inventors: Norbert Weis, Weinheim (DE); Hans-Jörg Clemen, Heidelberg (DE); Marc Hunger, Viernheim (DE)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 14/366,827

(22) PCT Filed: Sep. 5, 2012

(86) PCT No.: PCT/EP2012/003714

§ 371 (c)(1),
(2), (4) Date: Jul. 8, 2014

(87) PCT Pub. No.: WO2013/091739

PCT Pub. Date: Jun. 27, 2013

(65) Prior Publication Data

US 2014/0325780 A1 Nov. 6, 2014

(30) Foreign Application Priority Data

Dec. 22, 2011 (DE) ..... 10 2011 122 106

(51) Int. Cl.

| | |
|---|---|
| ***A46B 9/00*** | (2006.01) |
| ***A46B 9/06*** | (2006.01) |
| ***A46B 9/02*** | (2006.01) |
| *A46D 1/00* | (2006.01) |

(52) U.S. Cl.

CPC ..... *A46B 9/025* (2013.01); *A46B 9/00* (2013.01); *A46B 9/06* (2013.01); *A46D 1/0238* (2013.01); *A46B 2200/302* (2013.01); *A46D 1/0253* (2013.01)

(58) Field of Classification Search

CPC .. A46B 2200/302; A46B 9/00; A46D 1/0238; A46D 1/0253

USPC ..... 15/159.1, 171, 106

See application file for complete search history.

(56) References Cited

U.S. PATENT DOCUMENTS

| | | | | | |
|---|---|---|---|---|---|
| 1,457,414 | A * | 6/1923 | Adams | A46B 3/08 | 15/171 |
| 1,472,853 | A * | 11/1923 | Neff | A46B 3/08 | 15/177 |
| 1,981,657 | A * | 11/1934 | Miller | 15/167.1 | |
| 2,637,893 | A * | 5/1953 | Shaw | A46D 1/00 | 124/90 |
| 2,712,145 | A * | 7/1955 | Karnes | A46B 7/04 | 15/146 |

(Continued)

FOREIGN PATENT DOCUMENTS

| | | | | |
|---|---|---|---|---|
| CA | CA 2501038 A1 * | 9/2005 | ..... | A46B 7/02 |
| CH | 73558 A | 11/1916 | | |

(Continued)

*Primary Examiner* — Michael Jennings

(74) *Attorney, Agent, or Firm* — Fraser Clemens; Martin & Miller LLC; James D. Miller

(57) ABSTRACT

In respect of the problem of specifying a broom head which can readily sweep up differently sized particles and mixtures of the same, a broom head comprising a basic body (100), from which clusters (1, 3, 5, 7, 8, 9, 10, 13) of bristles project, characterized in that the clusters (1, 3, 5, 7, 8, 9, 10, 13) have a cross section which is neither round nor circular.

3 Claims, 21 Drawing Sheets

(56) References Cited

U.S. PATENT DOCUMENTS 3,186,018 A * 6/1965 Shaw ..... A46D 1/00 15/159.1
3,497,900 A * 3/1970 Kutik et al. ..... 15/104.93
3,619,845 A 11/1971 Partridge et al.
4,749,233 A 6/1988 Weihrauch
5,274,873 A * 1/1994 Shields ..... 15/167.1
5,590,438 A * 1/1997 Chen ..... A46B 3/16 15/167.1
5,786,087 A * 7/1998 Cansler ..... A46D 1/00 15/159.1
5,850,660 A * 12/1998 O'Halloran ..... A46D 1/00 15/167.1
6,095,910 A * 8/2000 Luedeke ..... B24B 29/005 451/359
6,217,124 B1 * 4/2001 Jespersen ..... A46D 3/02 15/179
6,446,295 B1 * 9/2002 Calabrese ..... 15/28
7,305,731 B2 * 12/2007 Graham ..... A47L 25/08 15/159.1
7,788,756 B2 * 9/2010 Kraemer ..... 15/28
8,056,176 B2 * 11/2011 Claire-Zimmet et al. ..... 15/28
8,196,249 B1 * 6/2012 Spooner et al. ..... 15/117
8,444,416 B2 * 5/2013 Chenvainu et al. ..... 433/80
8,695,148 B2 * 4/2014 Russell et al. ..... 15/167.1
8,813,292 B2 * 8/2014 Driesen et al. ..... 15/28
2004/0185762 A1 * 9/2004 Turch et al. ..... 451/490
2004/0255427 A1 12/2004 Gavney, Jr.
2005/0039279 A1 * 2/2005 Koeth et al. ..... 15/167.1
2006/0236482 A1 * 10/2006 Georgi ..... 15/167.1
2006/0254011 A1 11/2006 Jones et al.
2007/0130710 A1 * 6/2007 Chen et al. ..... 15/115
2008/0014010 A1 * 1/2008 Bartschi et al. ..... 401/146
2008/0120798 A1 * 5/2008 Sorrentino et al. ..... 15/106
2008/0201886 A1 * 8/2008 Bielfeldt et al. ..... 15/167.2
2009/0255077 A1 * 10/2009 Mori et al. ..... 15/167.1
2010/0229316 A1 * 9/2010 Hohlbein et al. ..... 15/167.1
2011/0239391 A1 * 10/2011 Driesen et al. ..... 15/167.1
2011/0308029 A1 * 12/2011 Edelstein et al. ..... 15/167.1
2012/0204371 A1 * 8/2012 Chun et al. ..... 15/167.1
2012/0279520 A1 * 11/2012 Sarris ..... A46D 1/0207 134/6

FOREIGN PATENT DOCUMENTS

DE 29516571 U1 1/1996
DE 19909435 A1 9/2000
DE WO 0152697 A1 * 7/2001 ..... A46B 9/02
EP 0193074 A2 9/1986
EP 1595473 A1 11/2005
FR 2898785 A1 9/2007
WO 2009018027 A2 2/2009

* cited by examiner

BROOM HEAD WITH BRISTLE STRUCTURE

CROSS-REFERENCE TO RELATED APPLICATION

This application is a U.S. National Phase Application based on International PCT/EP2012/003714 filed Sep. 5, 2012 and also claims priority to German Patent Application Serial No. DE 10 2011 122 106.2 filed Dec. 22, 2011, the entire disclosures of which are hereby incorporated herein by reference.

TECHNICAL FIELD

The invention relates to a broom head according to the preamble of patent claim 1.

PRIOR ART

The prior art discloses broom heads, from which bristles which are combined into clusters project. The known broom heads have bristles with a substantially round cross section.

These broom heads cannot capture and sweep fine dust and coarse particles, which are mixed with one another, to a sufficiently good standard.

SUMMARY OF THE INVENTION

The invention is therefore based on the object of specifying a broom head with which particles of different size and mixtures of same can easily be swept.

The present invention achieves the abovementioned object by means of the features of patent claim 1.

According to the invention, a broom head comprises a main body from which clusters of bristles project, wherein the clusters have a cross section which differs from a round or circular shape. According to the invention, it has been recognized that clusters, the cross sections of which differ from a round shape, can capture and sweep mixtures of particles of differing size to a particularly good standard.

As a result, the object referred to at the beginning is achieved.

Elongate clusters with rounded corner regions could project from the main body. Said clusters collect fine dust and provide a barrier for the latter.

Clusters which are triangular in cross section could project from the main body. By this means, the clusters are stiffened and can better capture particles.

Clusters which are rectangular in cross section could project from the main body. These clusters also collect fine dust and provide a barrier for the latter.

Elongate clusters which are square in cross section could project from the main body. The cross section of said clusters describes an irregular square. Fine dust can be captured with clusters of this type.

Clusters which are kidney-shaped in cross section could project from the main body. This cross-sectional shape has proven particularly suitable for capturing dust particles.

Clusters which are oval in cross section could project from the main body. Said clusters supplemented by lamellas can capture dry and/or wet particles and hair to a particularly good standard.

Clusters which are V-shaped in cross section could project from the main body. Fine dust can be captured particularly readily with such clusters.

Combined clusters which have harder and/or stiffer bristles in the center thereof than in the peripheral region thereof could project from the main body. These clusters can detach tenacious dirt particularly readily.

At least one lamella could project from the main body. A wide wiping surface is provided by a lamella. Said wiping surface can remove films of moisture particularly readily. Lamellas are preferably manufactured from elastomer, in particular from rubber.

Against this background, at least one lamella could be configured as a rubber blade. Rubber is solvent-resistant and flexible.

At least one lamella could be curved. Hair, particles or moist dirt particles can be captured particularly readily.

At least one lamella could be wavy. By this means, the contact of the wiping surface of the lamella with the surface to be cleaned is improved.

At least one lamella could be configured in the manner of a comb. Hair can thus be picked up from a surface to be cleaned and removed from the lamella particularly readily.

At least one cluster could have bristles, the diameter of which is more than 0.3 mm, preferably 0.4 to 0.6 mm. These hard bristles are preferably arranged in peripheral regions of the broom head, since they are suitable for cleaning corners.

At least one cluster could have bristles, the diameter of which is less than 0.25 mm. These softer bristles serve for removing dust from cracks or joints.

WAY OF IMPLEMENTING THE INVENTION

FIGS. 1 to 21 each show a broom head comprising a main body 100 from which clusters 1, 3, 5, 7, 8, 9, 10, 13 of bristles project. The clusters 1, 3, 5, 7, 8, 9, 10, 13 have a cross section which differs from a round or circular shape.

Figure 1:
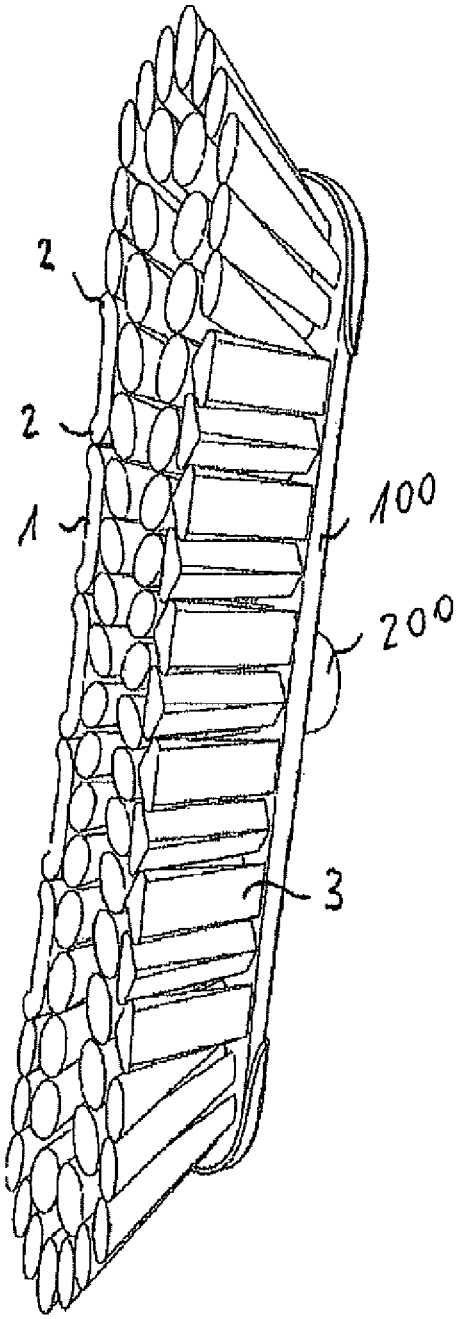
FIG. 1 shows a broom head with elongate clusters which are triangular in cross section.

FIG. 1 shows that elongate clusters 1 with rounded corner regions 2 project from the main body 100. Furthermore, clusters 3 which are triangular in cross section project from the main body 100. FIG. 1 shows a broom head with elongate clusters 1 with rounded corner regions 2. Said clusters serve as a barrier for fine dust. Clusters 3 which are substantially triangular in cross section provide the bristle structure with improved rigidity for sweeping particles.

Figure 2:
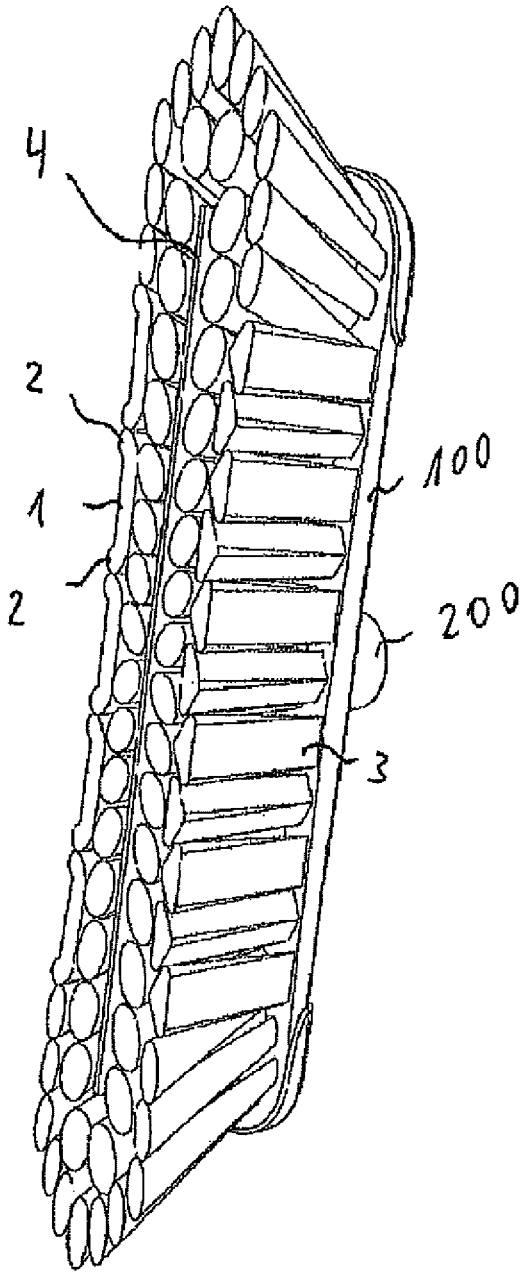
FIG. 2 shows a broom head with elongate clusters which are triangular in cross section, wherein a rubber blade is additionally provided.

FIG. 2 shows a broom head with elongate clusters 1 with rounded corner regions 2; Said clusters serve as a barrier for fine dust. Clusters 3 which are substantially triangular in cross section provide the bristle structure with improved rigidity for sweeping particles. A rubber blade 4 for sweeping fine dust is accommodated in the interior of the bristle structure. The rubber blade 4 is surrounded on all sides by clusters.

Figure 3:
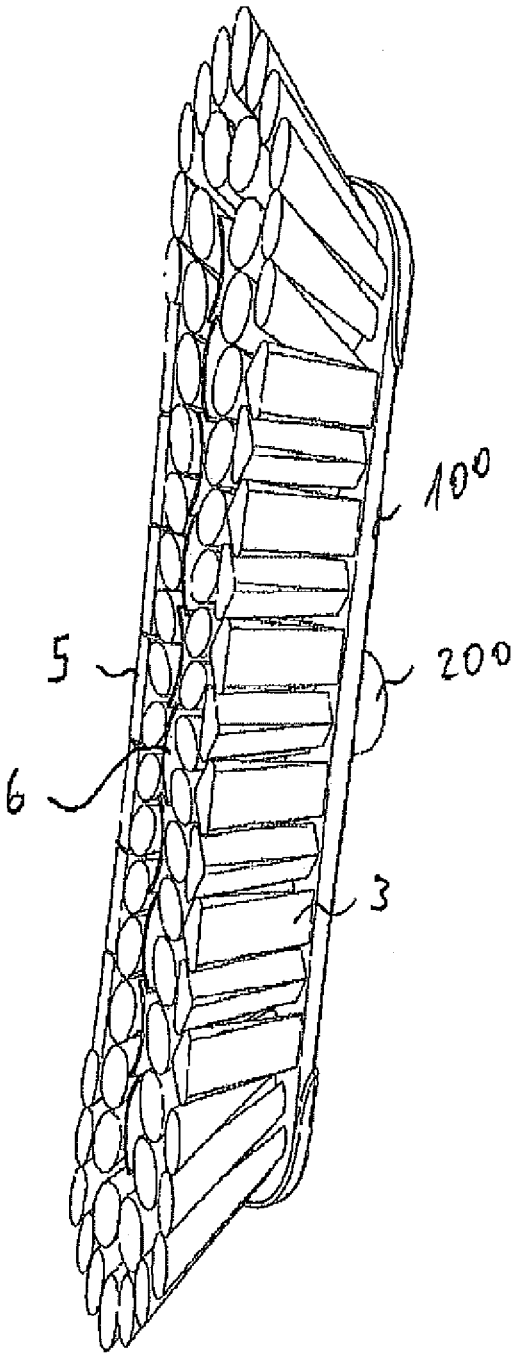
FIG. 3 shows a broom head with clusters which are triangular and rectangular in cross section, wherein curved rubber blades are additionally provided.

FIG. 3 shows specifically that at least one lamella which is designed as a rubber blade 6 projects from the main body 100. The lamellas shown in FIG. 3 are curved. FIG. 3 shows a broom head with clusters 5 which are rectangular in cross section. Said clusters serve as a barrier for fine dust. The clusters 3 which are substantially triangular in cross section provide the bristle structure with improved rigidity for sweeping particles. A plurality of rubber blades 6 for sweeping fine dust are accommodated in the interior of the bristle structure. The rubber blades 6 are surrounded on all sides by clusters and are arranged in a row. Each rubber blade 6 has a curved surface. This optimizes the picking up of dust particles.

Figure 4:
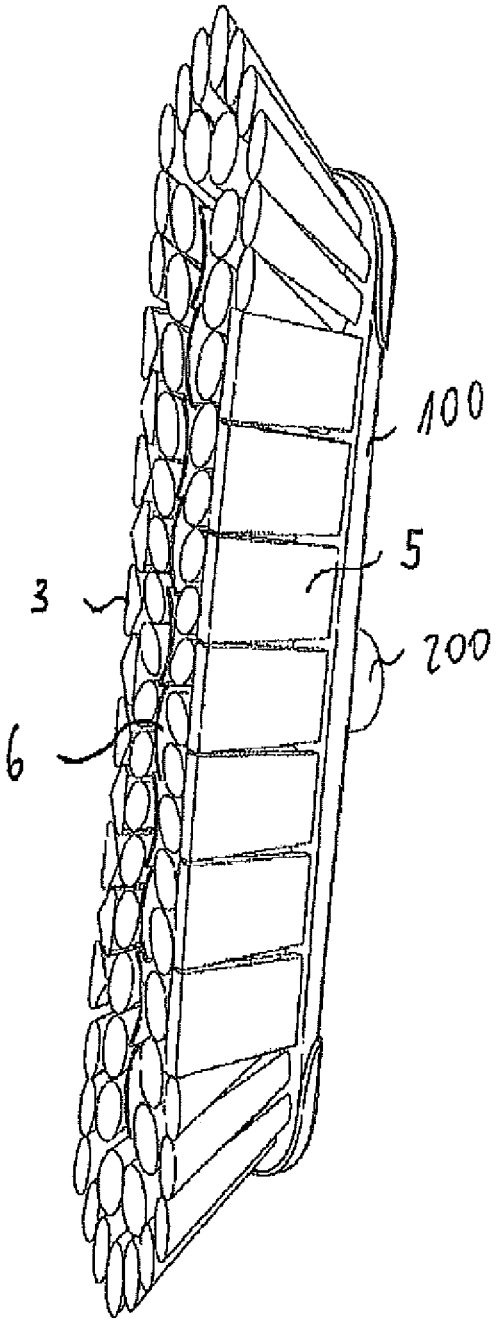
FIG. 4 shows a further view of the broom head according to FIG. 3.

FIG. 4 shows the broom head according to FIG. 3 in a different view.

Figure 5:
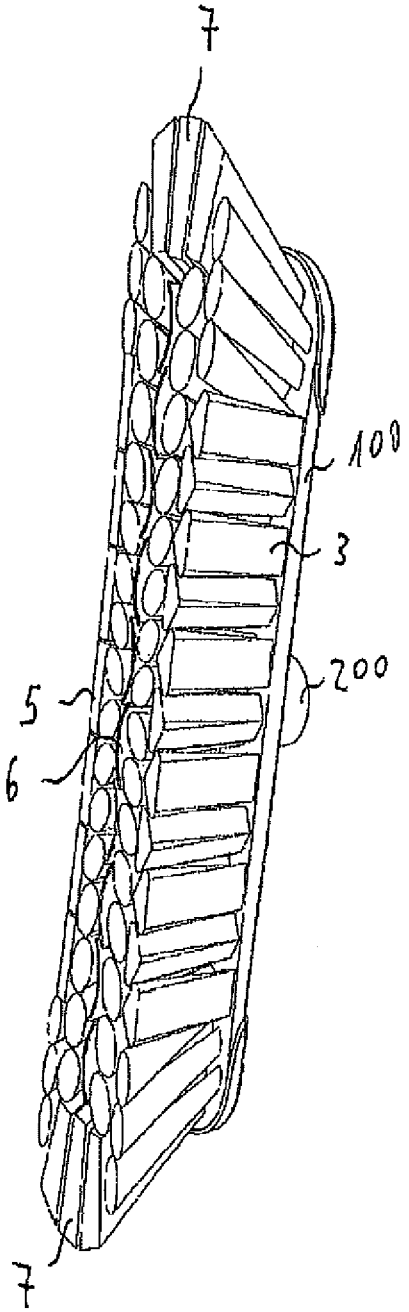
FIG. 5 shows a broom head with clusters which are triangular and rectangular in cross section, wherein curved rubber blades and, at the longitudinal ends of the broom head, elongate clusters which are square in cross section are additionally provided.

FIG. 5 shows that clusters 5 which are rectangular in cross section project from the main body 100. FIG. 5 also shows that elongate clusters 7 which are square in cross section project from the main body 100. FIG. 5 shows a broom head with clusters 5 which are rectangular in cross section. Said clusters serve as a barrier for fine dust. The clusters 3 which are triangular in cross section provide the bristle structure with improved rigidity for sweeping particles. A plurality of rubber blades 6 for sweeping fine dust are accommodated in the interior of the bristle structure. The rubber blades 6 are surrounded on all sides by clusters and are arranged in a row. Each rubber blade 6 has a curved surface. This optimizes the picking up of dust particles. At the longitudinal ends of the broom head, elongate clusters 7 which are square in cross section are arranged on both sides.

Figure 6:
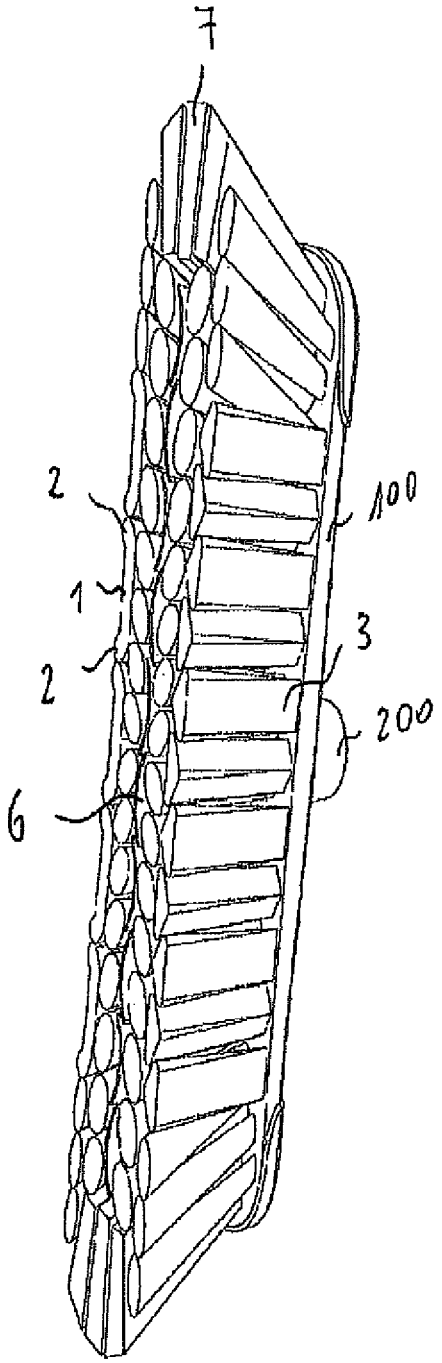
FIG. 6 shows a broom head with elongate clusters and clusters which are triangular in cross section, wherein curved rubber blades and, at the longitudinal ends of the broom head, elongate clusters which are square in cross section are additionally provided.

FIG. 6 shows a broom head with elongate clusters 1 with rounded corner regions 2. Said clusters serve as a barrier for fine dust. The clusters 3 which are substantially triangular in cross section provide the bristle structure with improved rigidity for sweeping particles. A plurality of rubber blades 6 for sweeping fine dust are accommodated in the interior of the bristle structure. The rubber blades 6 are surrounded on all sides by clusters and are arranged in a row. Each rubber blade 6 has a curved surface. This optimizes the picking up of dust particles. At the longitudinal ends of the broom head, elongate clusters 7 which are square in cross section are arranged on both sides.

Figure 7:
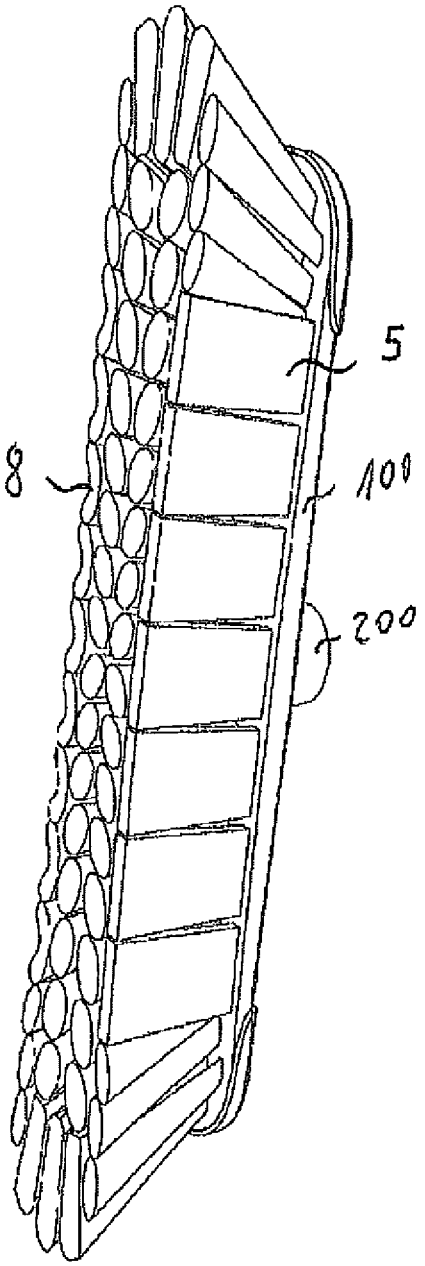
FIG. 7 shows a broom head with clusters which are kidney-shaped in cross section and clusters which are rectangular in cross section.
Figure 8:
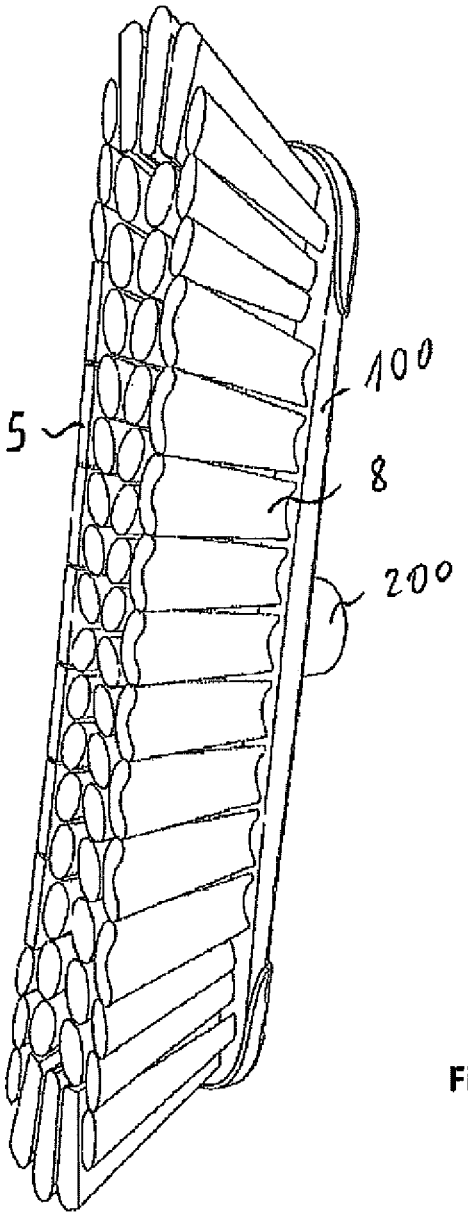
FIG. 8 shows a further view of the broom head according to FIG. 7.
Figure 9:
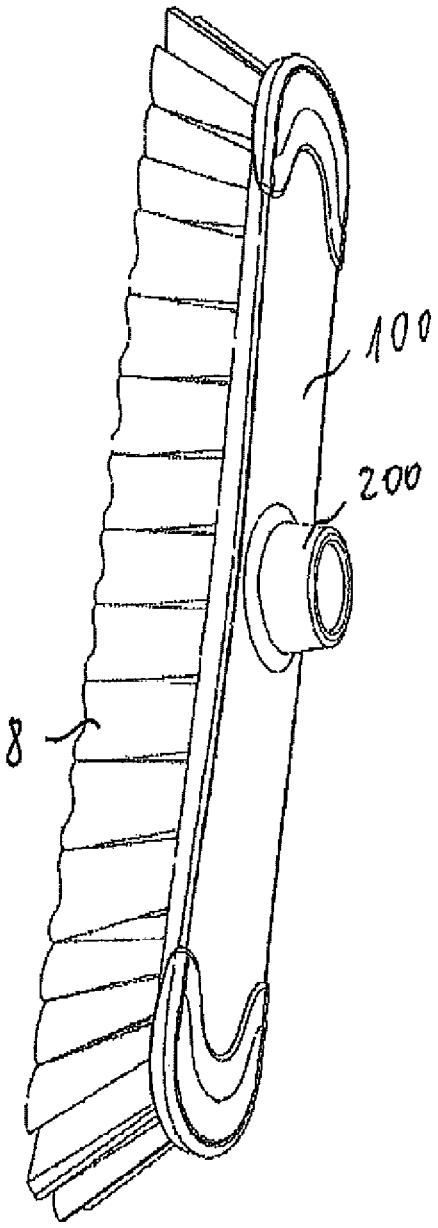
FIG. 9 shows a further view of the broom head according to FIG. 7.
Figure 10:
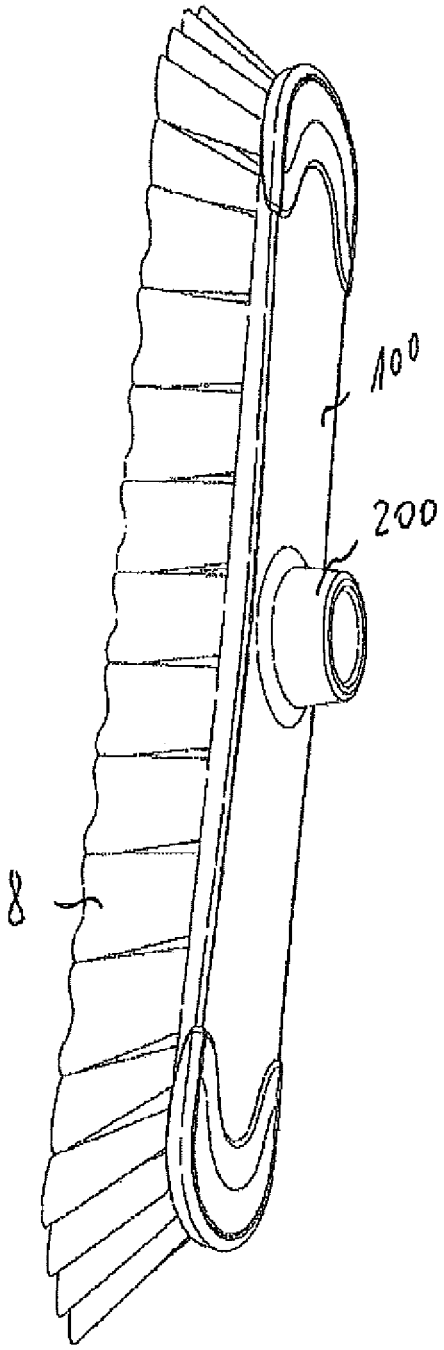
FIG. 10 shows a further view of the broom head according to FIG. 7.
Figure 11:
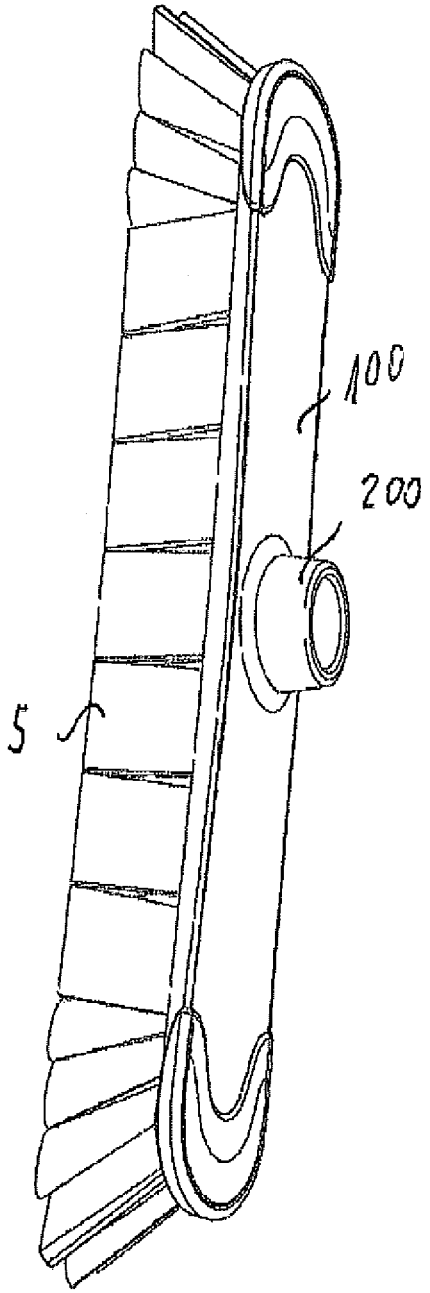
FIG. 11 shows a further view of the broom head according to FIG. 7.

FIG. 7 shows that clusters 8 which are kidney-shaped in cross section project from the main body 100. FIG. 7 also shows a broom head with clusters 5 which are rectangular in cross section. Said clusters serve as a barrier for fine dust. The clusters 8 which are kidney-shaped in cross section bring about a better sweeping capacity.

FIGS. 8 to 11 show various views of the broom head according to FIG. 7.

Figure 12:
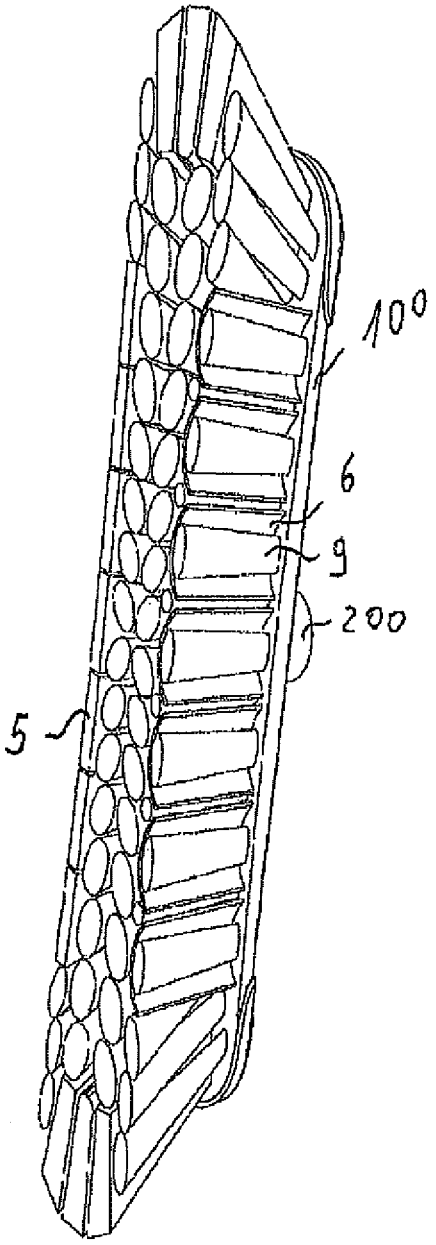
FIG. 12 shows a broom head with clusters which are rectangular in cross section, wherein curved rubber blades which, in each case in the concave side thereof, accommodate a cluster which is oval in cross section are additionally provided.

FIG. 12 shows that clusters 9 which are oval in cross section project from the main body 100. FIG. 12 also shows a broom head with clusters 5 which are rectangular in cross section. Said clusters serve as a barrier for fine dust. The clusters 9 which are oval in cross section are arranged on a concave side of curved rubber blades 6. The rubber blades 6 which are substantially curved in a crescent-shaped manner can sweep and pick up dry and/or wet particles and hair particularly readily. The clusters 9 which are oval in cross section and the clusters 5 which are rectangular in cross section are arranged on mutually opposite outer sides of the broom head.

Figure 13:
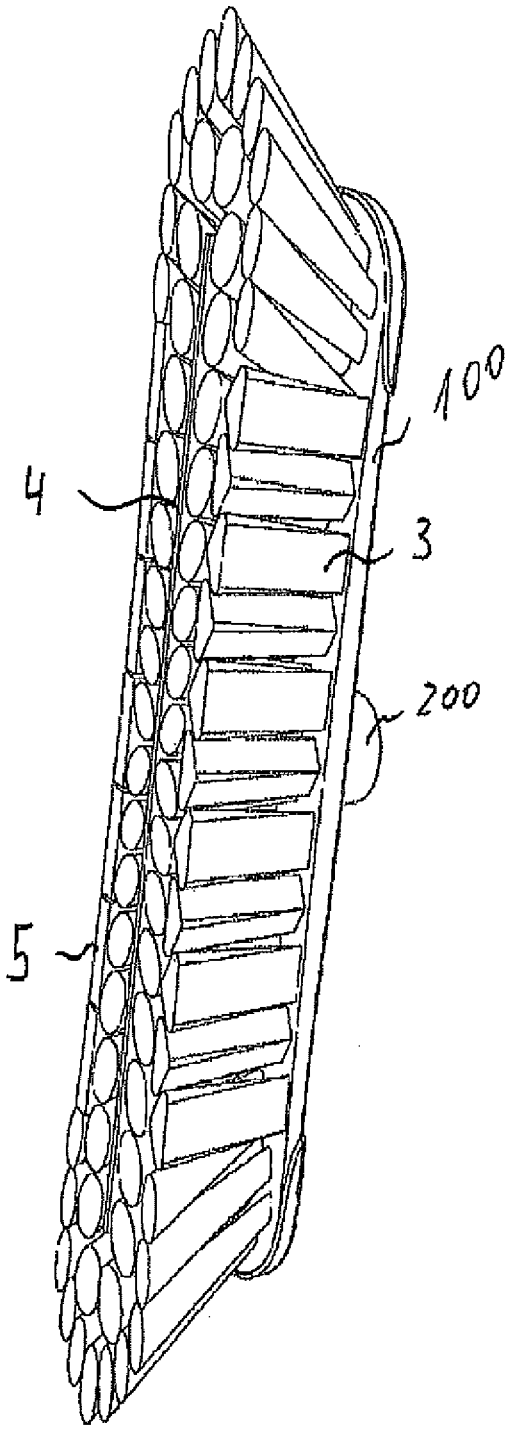
FIG. 13 shows a broom head with clusters which are rectangular and triangular in cross section, wherein a rubber blade is additionally provided.

FIG. 13 shows a broom head with clusters 5 which are rectangular in cross section. Said clusters serve as a barrier for fine dust. Clusters 3 which are substantially triangular in cross section provide the bristle structure with improved rigidity for sweeping particles. A rubber blade 4 for sweeping fine dust is accommodated in the interior of the bristle structure. The rubber blade 4 is surrounded on all sides by clusters. The rubber blade 4 is a continuous, flat rubber blade 4.

Figure 14:
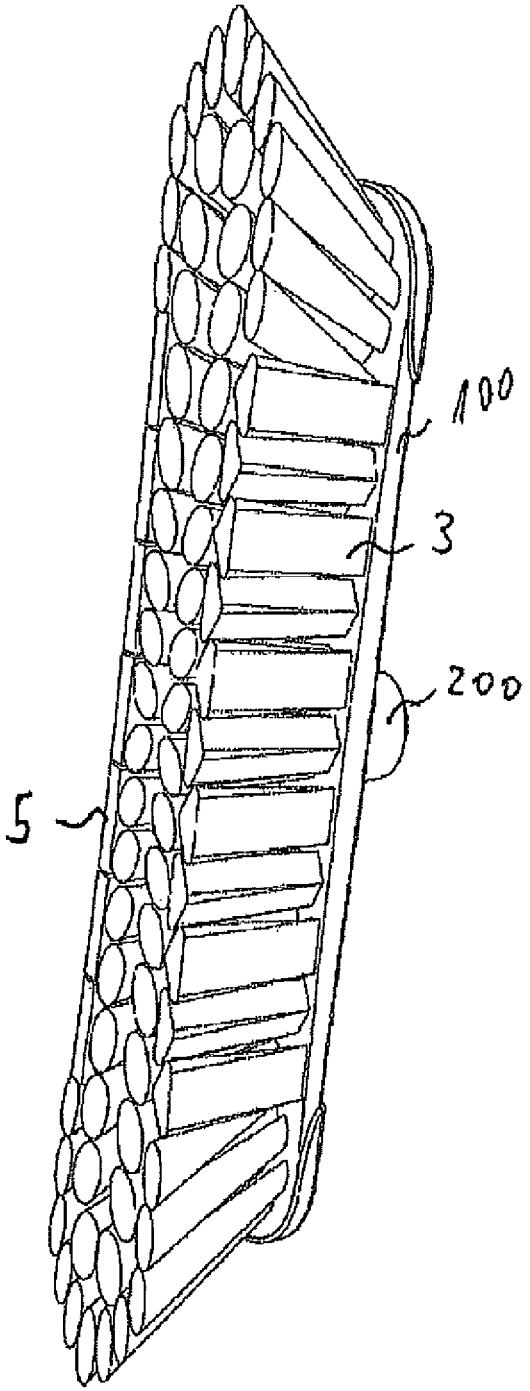
FIG. 14 shows a broom head with clusters which are rectangular and triangular in cross section.

FIG. 14 shows a broom head with clusters 5 which are rectangular in cross section. Said clusters serve as a barrier for fine dust. Clusters 3 which are substantially triangular in cross section provide the bristle structure with improved rigidity for sweeping particles.

Figure 15:
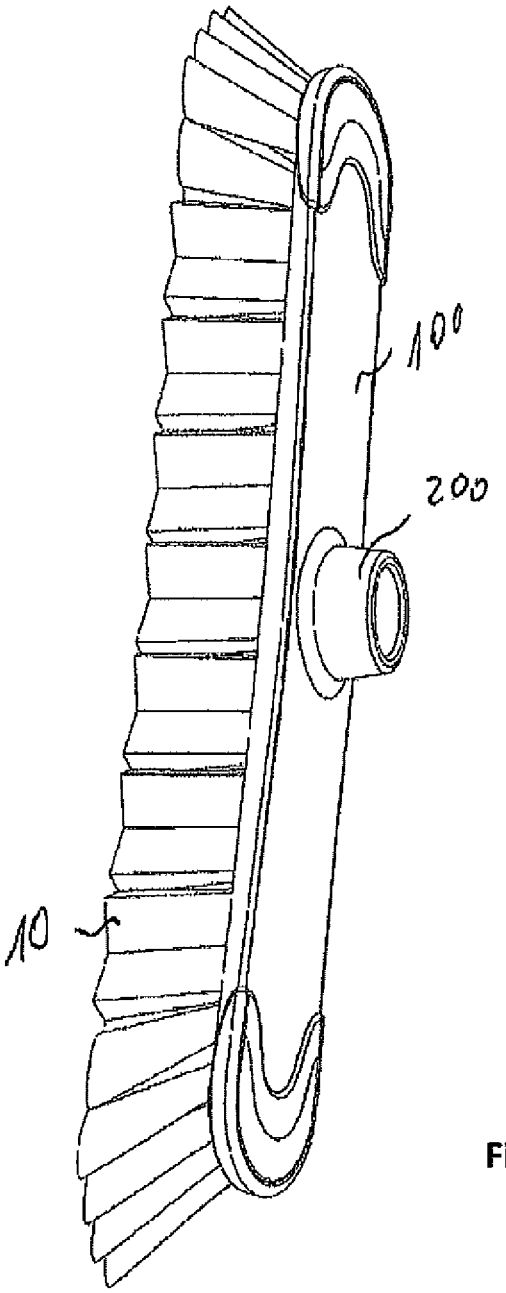
FIG. 15 shows a broom head with clusters which are V-shaped in cross section and with a rubber blade which is designed in the manner of a comb.
Figure 16:
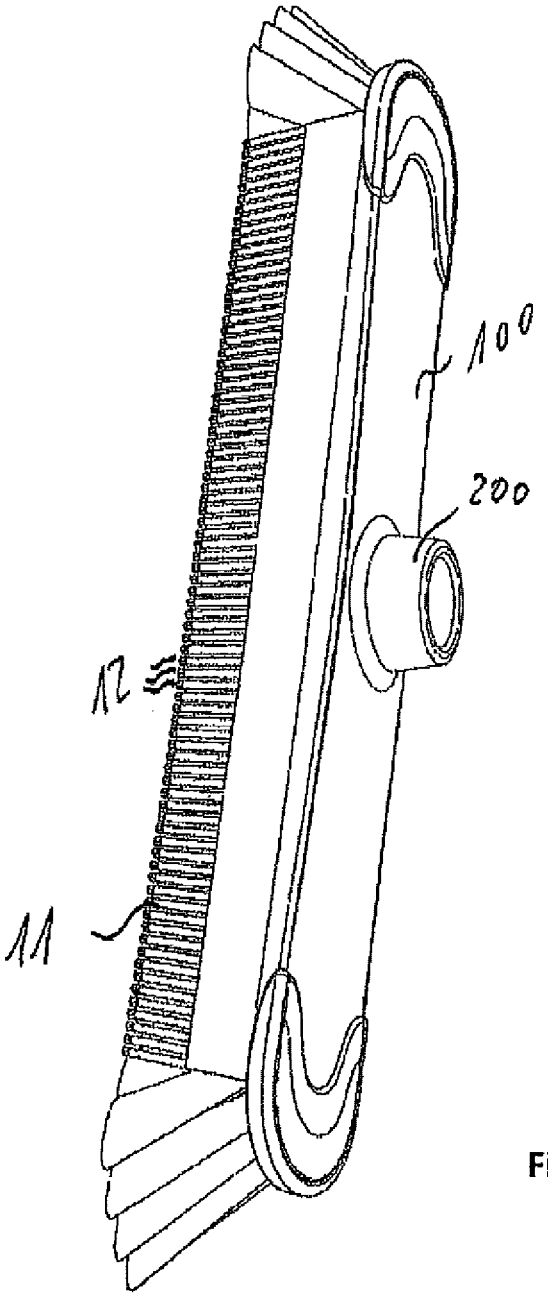
FIG. 16 shows a further view of the broom head according to FIG. 15.
Figure 17:
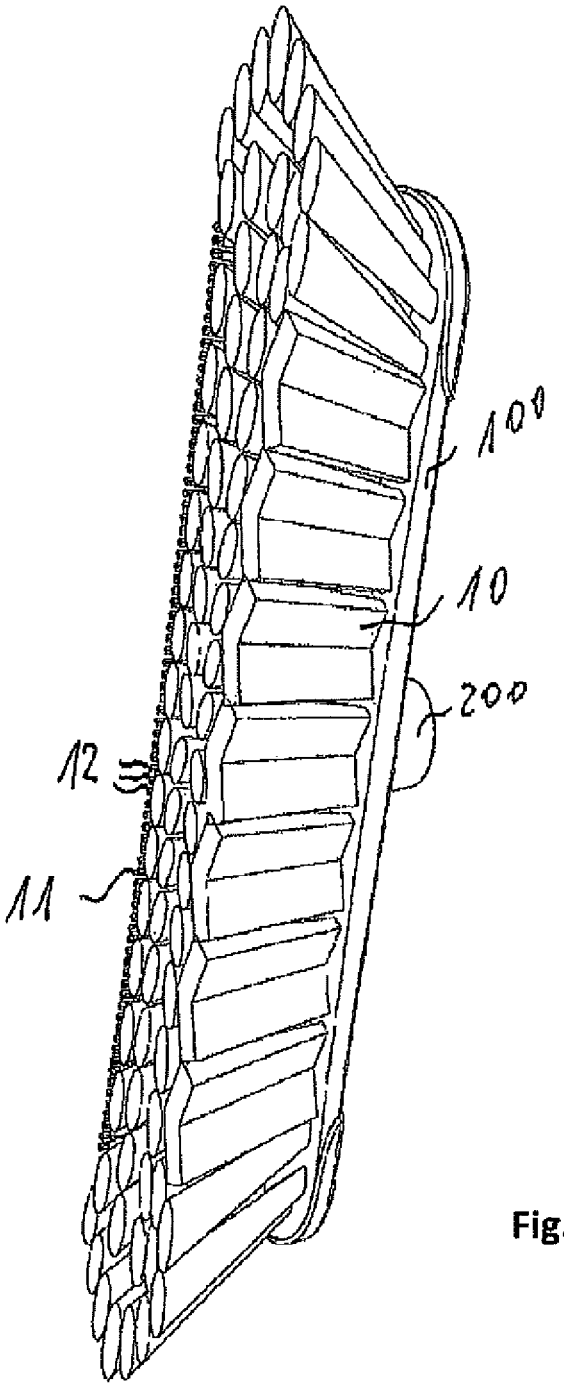
FIG. 17 shows a further view of the broom head according to FIG. 15.

FIGS. 15 to 17 show a broom head which has clusters 10 which are V-shaped in cross section and are arranged on an outer side of the broom head. The clusters 10 which are V-shaped in cross section serve as a barrier for fine dust. A rubber blade 11 which is configured in the manner of a comb is arranged on the outer side opposite the first outer side. Said rubber blade 11 which is configured in the manner of a comb can pick up hair particularly readily. Hair can be removed particularly readily between the comb strips 12.

FIG. 17 shows that clusters 10 which are V-shaped in cross section project from the main body 100. FIG. 17 also shows that at least one lamella is configured in the manner of a comb.

Figure 18:
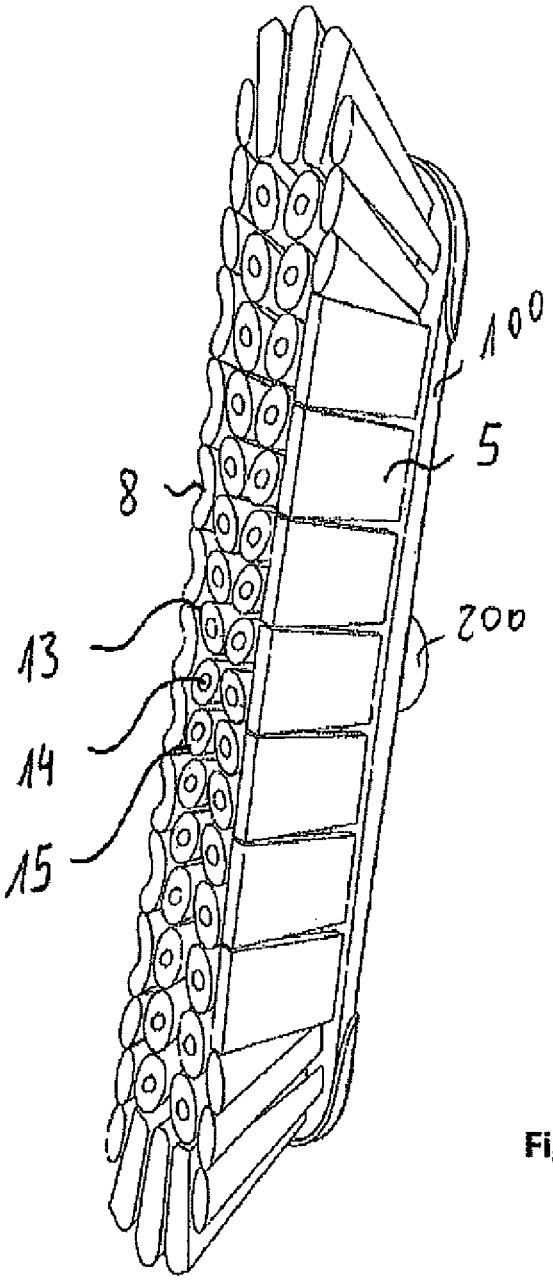
FIG. 18 shows a broom head with clusters which are kidney-shaped in cross section and clusters which are rectangular in cross section, wherein clusters which have stiffer bristles in the interior thereof than in the peripheral region thereof are provided.

FIG. 18 shows that combined clusters 13 which have harder and/or stiffer bristles in the center 14 thereof than in the peripheral region 15 thereof project from the main body 100. FIG. 18 also shows a broom head with clusters 5 which are rectangular in cross section. Said clusters serve as a barrier for fine dust. Clusters 8 which are kidney-shaped in cross section bring about a better sweeping capacity. Combined clusters 13 which have harder and/or stiffer bristles in the center 14 thereof than in the peripheral region 15 thereof are arranged between the clusters 8 which are kidney-shaped in cross section and the clusters 5 which are rectangular in cross section. The peripheral region 15 surrounds the center 14 in the manner of a shell. The bristles in the center 14 can detach tenacious dirt.

Figure 19:
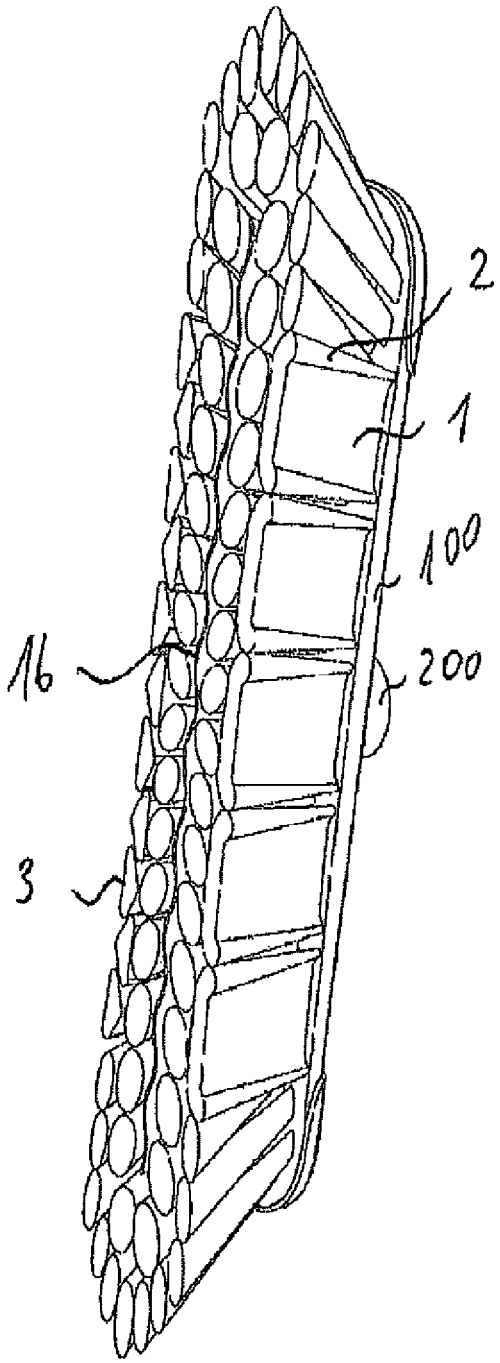
FIG. 19 shows a broom head with elongate clusters and clusters which are triangular in cross section, wherein a wavy rubber blade is additionally provided.

FIG. 19 shows that at least one lamella which is configured as a wavy rubber blade 16 projects from the main body 100.

Figure 20:
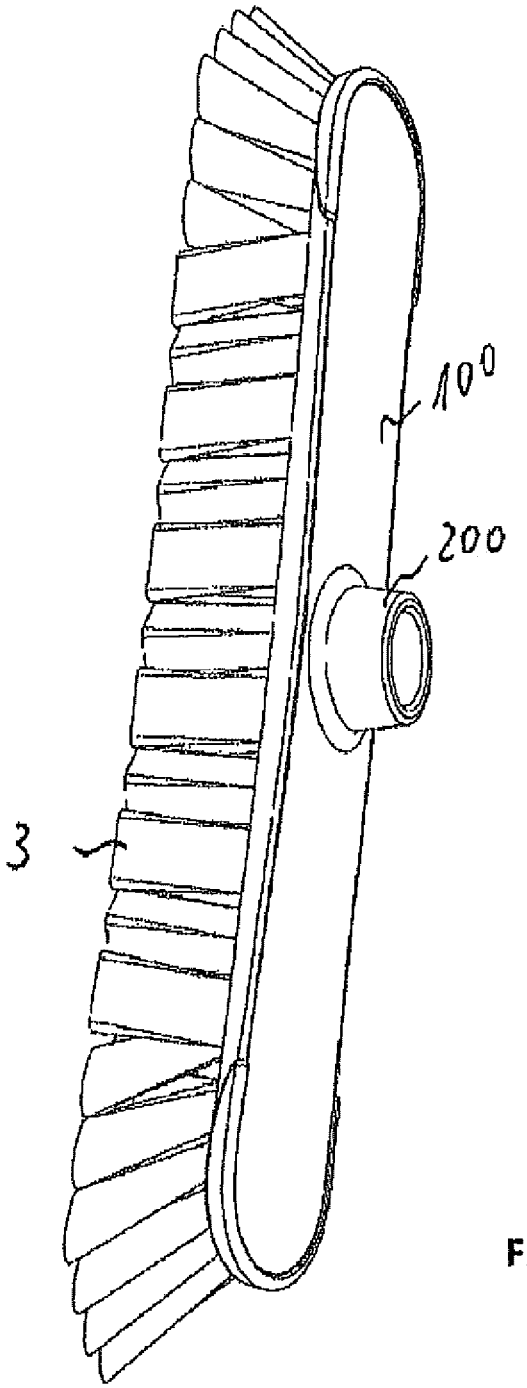
FIG. 20 shows a further view of the broom head according to FIG. 19.
Figure 21:
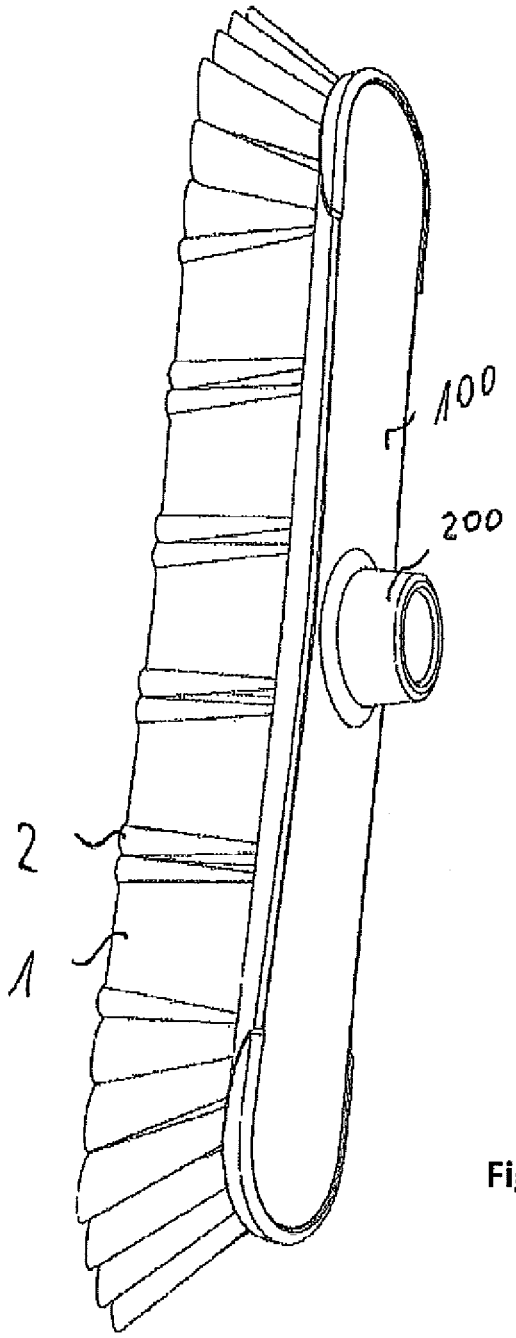
FIG. 21 shows a further view of the broom head according to FIG. 19.

FIGS. 19 to 21 in each case show a broom head with elongate clusters 1 with rounded corner regions 2. Said clusters serve as a barrier for fine dirt. Clusters 3 which are substantially triangular in cross section provide the bristle structure with improved rigidity for sweeping particles. A wavy rubber blade 16 for sweeping fine dust is accommodated in the interior of the bristle structure. The wavy rubber blade 16 is surrounded on all sides by clusters. The waviness of the wavy rubber blade 16 brings about better contact with the floor.

The lamellas shown in the respective figures can be manufactured from thermoplastic elastomers. The bristles of the clusters 1, 3, 5, 7, 8, 9, 10, 13 can be manufactured from polyethylene terephthalate. The respective bristles can have different thicknesses.

The main body 100 shown in the figures has a receptacle 200 for a broom handle. The receptacle 200 can have a thread.

The invention claimed is:

1. A broom head, comprising:

a main body having a width greater than a length;

a plurality of clusters of bristles projecting from the main body and spaced along the width and the length of the main body, each cluster including a plurality of bristles, wherein at least a portion of the clusters of bristles have a non-circular cross sectional shape, and wherein the clusters of bristles have at least two of an elongate cross sectional shape with rounded corner regions, a triangular cross sectional shape, a rectangular cross sectional shape, a square cross sectional shape, a kidney-shaped cross sectional shape, an oval cross sectional shape, and a V-shaped cross sectional shape;

a plurality of lamella projecting from the main body in a same direction as the clusters of bristles and disposed between a portion of the clusters of bristles, each lamella directly adjacent another lamella and arranged in a row, the plurality of lamella surrounded on all sides by the clusters of bristles; and a receptacle on the main body configured to receive a broom handle substantially perpendicular to the width of the main body.

2. The broom head as claimed in claim 1, wherein at least a portion of the clusters of bristles have at least one of harder bristles and stiffer bristles in a center of the clusters of bristles than in a peripheral region of the clusters of bristles.

3. The broom head as claimed in claim 1, wherein the bristles have a diameter of between 0.4 mm to 0.6 mm.

* * * * *